United States Patent [19]

Litchfield

[11] 4,108,520

[45] Aug. 22, 1978

[54] DRAWERS

[75] Inventor: Leon George Litchfield, Belper, England

[73] Assignee: L. B. (Plastics) Limited, Derby, England

[21] Appl. No.: 723,499

[22] Filed: Sep. 15, 1976

[30] Foreign Application Priority Data

Sep. 17, 1975 [GB] United Kingdom ..... 38162/75

[51] Int. Cl.[2] ..... A47B 47/00

[52] U.S. Cl. ..... 312/330 R; 312/111; 312/140; 312/263

[58] Field of Search ..... 312/330, 351, 140, 111, 312/263

[56] References Cited

U.S. PATENT DOCUMENTS

| | | | |
|---|---|---|---|
| 959,940 | 5/1910 | Hunter | 312/140 |
| 2,499,299 | 2/1950 | Curran | 312/330 |
| 3,282,635 | 11/1966 | Himelreich | 312/330 |
| 3,556,626 | 1/1971 | Schock | 312/330 |
| 3,610,720 | 10/1971 | Hosmer | 312/330 |
| 3,612,639 | 10/1971 | Williams | 312/330 |
| 3,687,512 | 8/1972 | Alston | 312/330 |
| 3,901,572 | 8/1975 | Litchfield | 312/330 |

FOREIGN PATENT DOCUMENTS

| | | | |
|---|---|---|---|
| 1,341,399 | 12/1973 | United Kingdom | 312/330 |

*Primary Examiner*—Mervin Stein
*Assistant Examiner*—Victor N. Sakran
*Attorney, Agent, or Firm*—Marshall & Yeasting

[57] ABSTRACT

A component for use in interconnecting the front and side walls of a drawer in which the walls are formed from hollow extruded plastic panels, the component comprising a corner post having locating members projecting in two directions at right angles to one another, and detents on the locating members for engagement in apertures in the wall panels, the detents on the locating members which engage the front wall panel being formed on the inner faces of the members.

5 Claims, 4 Drawing Figures

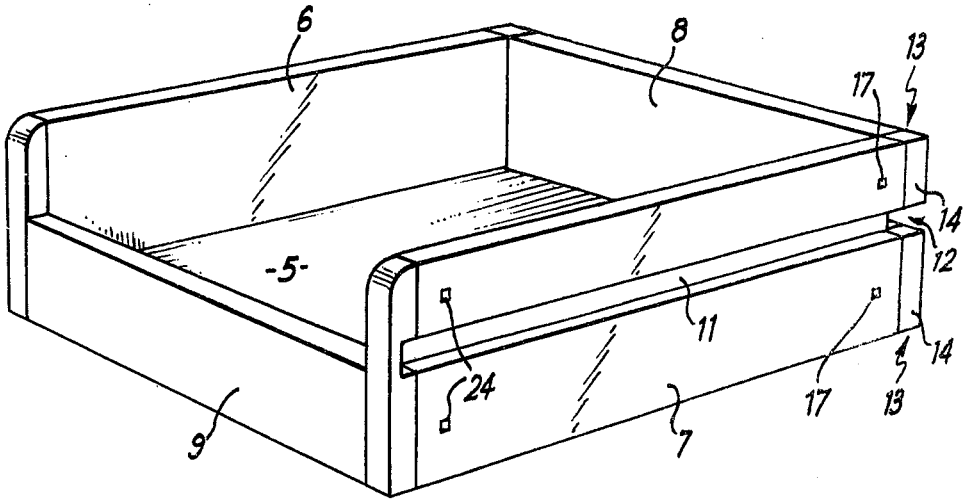
FIG. 1
FIG. 2
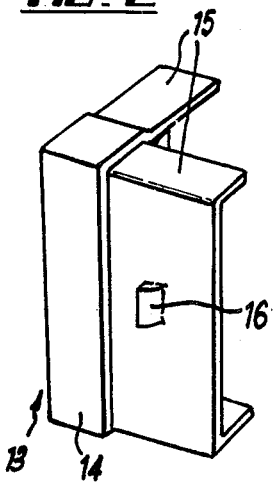
FIG. 4
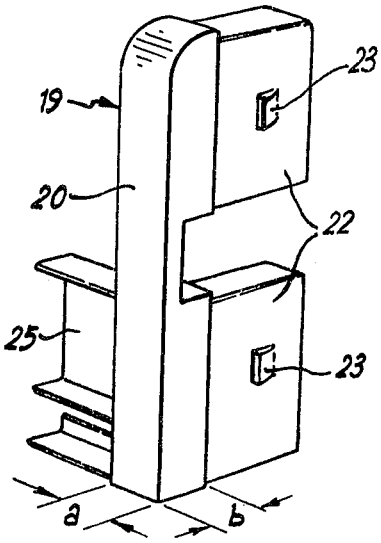

DRAWERS

The invention relates to drawers and components for use in constructing same.

The invention provides a component for use in interconnecting the front and side walls of a drawer construction in which the said walls are formed from hollow extruded plastic panels, the component comprising a corner post having locating members projecting therefrom in two directions at right angles to one another, and detents on the locating members for engagement in apertures in the wall panels, the detents on the or each locating member which engages the front wall panel being formed on the face thereof which is innermost in use.

Preferably the component includes two locating members projecting from the corner post in one direction for engagement with a relatively high side wall panel of the drawer and a single locating member projecting at right angles to said two locating members for engagement with a relatively low front wall panel.

The invention also provides a drawer construction having front and side walls formed from hollow extruded plastic panels interconnected at right angles to one another by corner components according to either of the preceding paragraphs.

Preferably the back and side panels of the drawer are formed from identical hollow extruded plastic panels each provided with a longitudinal recess in the face thereof which will be innermost in use in order to accommodate a drawer bottom, each panel consisting of upper and lower hollow portions interconnected by a single longitudinal web which defines a longitudinal groove or channel in the face of the panel opposite to that in which said longitudinal recess is formed, the channels so formed in the panels forming the sides of the drawer being adapted to locate on runners forming part of a cabinet or the like in which the drawer is supported in use, and the front of the drawer having a longitudinal recess in the face thereof which will be innermost in use for co-operation with said recesses in the other wall panels.

Preferably the side wall panels are connected to the rear wall panel at right angles by upper and lower corner pieces comprising posts having projecting locating members engaging in the open ends of the respective upper and lower hollow portions of the panels and retained by means of detents engaging apertures formed in the wall panels.

The hollow portions of the wall panels may be divided internally by longitudinally extending webs. The upper and lower hollow portions of the side and back panels are preferably of identical construction save for the provision of said longitudinal recess in the innermost face of the lower portion.

Preferably also, the corner posts are arranged such that the portions thereof which remain exposed following connection of the panels are of slightly different lengths when viewed in plan such that the panels overlap one another. This presents a neat appearance to the interior of the assembled drawer and eliminates unsightly gaps through which the interior of the corner pieces could be seen.

An embodiment of the invention will now be described, by way of example only, with reference to the accompanying drawings, in which:

FIG. 1 is a perspective view of a drawer construction;

FIG. 2 is a perspective view showing a connecting piece used between the side and rear panels of the drawer construction shown in FIG. 1;

FIG. 4 is a perspective view of a corner piece used between the front and side panels of the drawer construction shown in FIG. 1.

Figure 3:
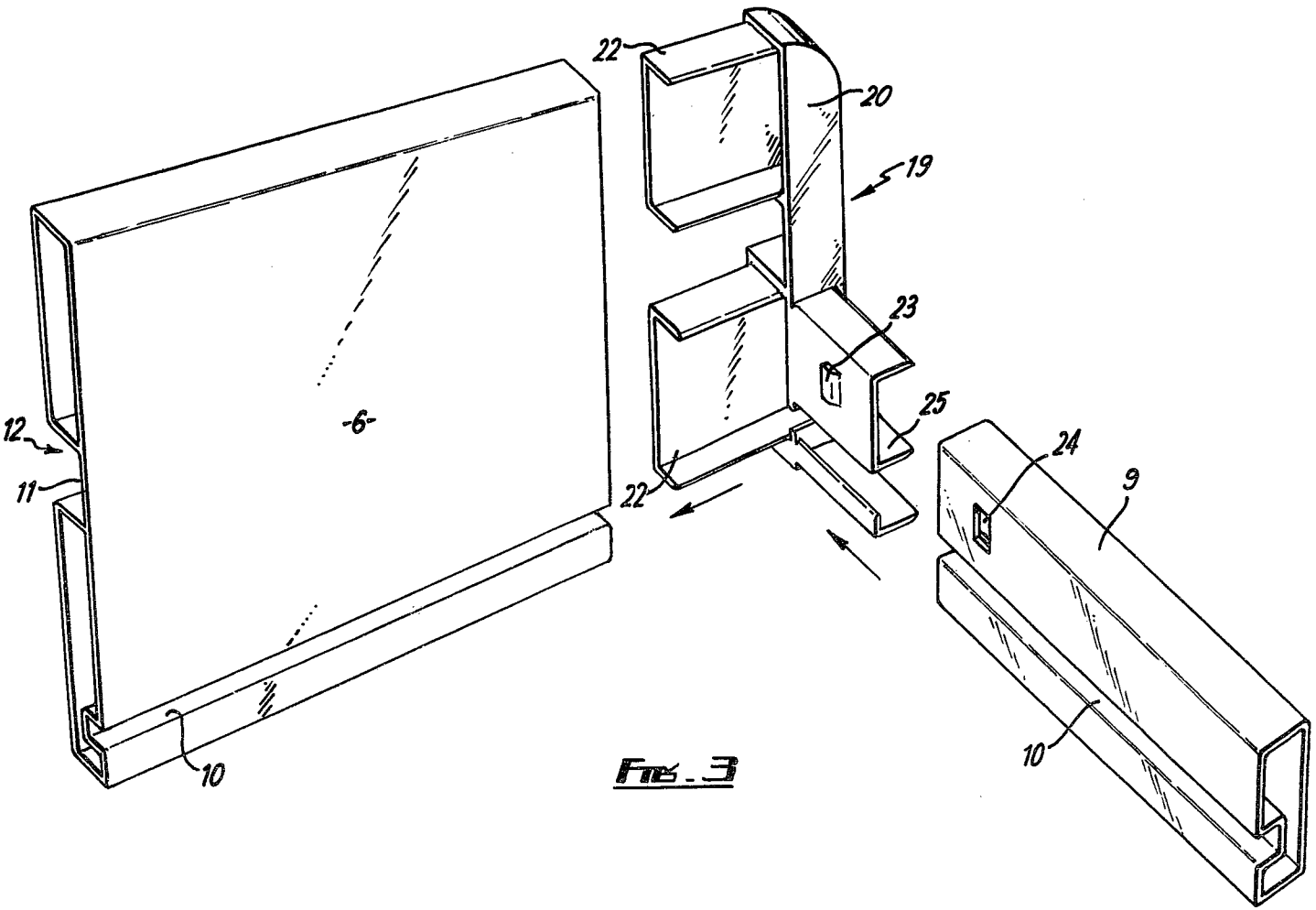
FIG. 3 is an exploded perspective view of a front corner of the drawer construction shown in FIG. 1.

Referring to the drawings, the drawer assembly comprises a drawer bottom 5 opposed side panels 6 and 7, a back panel 8 and a front panel 9. The side panels 6 and 7 and the back panel 8 are constructed from identical extruded sections of synthetic plastics material while the front panel 9 is constructed from an extruded section of synthetic plastics material which is of substantially lesser height than the sections forming the side and back panels. Each panel incorporates a longitudinal recess 10 near to the lower edge of the face of the panel which is innermost in use, these recesses 10 serving to receive the edges of the bottom 5.

The extruded sections forming the side panels 6 and 7 and back panel 8 consist of upper and lower hollow portions of rectangular section interconnected by a longitudinal web 11 which defines an opening or channel 12. The channels 12 in the two side panels 6 and 7 are adapted in use to locate over runners in a cabinet or other article of furniture in which the drawer is mounted so as to permit sliding movement of the drawer between open and closed positions.

The side panels 6 and 7 and back panel 8 are interconnected by corner pieces 13 one of which is shown in greater detail in FIG. 2. Each corner piece 13 consists of a post 14 having locating members 15 projecting from two adjacent sides thereof at right angles and dimensioned so as to form a relatively tight fit in one of the upper or lower hollow portions of a side or back panel. Two such corner pieces are utilised at each of the rear corners of the drawer construction and when engaged in the adjacent side and rear panels they connect these together at right angles to one another. In order to prevent accidental separation of the parts, the corner pieces are provided with projecting detent members 16 mounted centrally of each locating member 15. Each detent member 16 is chamfered in order that the corner pieces 13 may be readily pushed into the open end of the associated panel, the detent member 16 springing outwards into locking engagement with an associated opening 17 when the corner piece has been pushed fully home.

The extruded section forming the front panel 9 is hollow and has a cross-section substantially identical to the lower hollow portions of the side and back panels. The front panel 9 is connected to the side panels 6 and 7 by means of corner pieces 19 shown in detail in FIGS. 3 and 4. Each of these corner pieces consists of a post 20 having a pair of locating members 22 (similar to the locating members 15 on the corner pieces 13) projecting from one side thereof and dimensioned for engagement in the upper and lower hollow portions of the side panels 6 and 7. A further locating member 25 projects from the post 20 at right angles to the locating members 22, the locating member 25 being dimensioned for engagement in the hollow portion of the front panel 9 and being positioned such that the longitudinal recess 10 in the front panel 9 will co-operate with the longitudinal recesses 10 in the side and rear panels 6, 7 and 8 to support the bottom 5. Detent members 23 similar to those provided on the corner pieces 13 are provided on the outer faces of each of the locating members 22 and on the inner face of the locating member 25 and these engage with apertures 24 in the respective side and front panels to secure the parts against accidental separation. By providing the detent members 23 and the complementary apertures 24 on the inner faces of the respective components they are hidden from view when the drawer is in use and thereby contribute to a neat appearance. The upper end 26 of the post 20 is rounded for a similar purpose.

The channels 12 in the side wall panels 5 and 6 extend into the corner post 19 but terminate short of the front face of the post. This contributes to the neat appearance of the front of the assembled drawer and also acts as a stop ensuring that when the drawer is fully closed it nests in a predetermined position in the surrounding cabinet. This construction also obscures the drawer runner when viewed from the front of the cabinet.

The post 14 of each corner piece 13 and the post 20 of each corner piece 19 are of rectangular rather than square section in plan view, the distance *a* (FIGS. 2 and 4) slightly exceeding the distance *b*. As a result the adjacent edges of the back and side panels and of the front and side panels overlap one another slightly on the insides of the corners thereby forming a more satisfactory join and eliminating cracks or slots through which the interior of the corner pieces might otherwise be visible from within the drawer. By suitable marking of the corner pieces correct assembly of the components may be ensured.

Thus is manufacture of the drawer, the side and back panels may be cut to suitable lengths from a single extruded section, the holes 17 and 24 being punched in the side, back and front panels adjacent their respective ends after they have been cut to length. The walls may then be assembled around the bottom 5 and retained in place by means of the corner pieces 13 and 19. No other components are required to assemble the drawer.

The open-fronted drawer construction thus formed permits inspection of the contents of the drawer and allows access to the drawer even when the drawer is closed. Drawers of this construction are particularly suitable for the storage of clothing, for example in bedroom furniture, stationery in office furniture and similar applications.

Various modifications may be made without departing from the invention. For example alternative forms of corner pieces could be utilised and the side, back and front panels may have various arrangements of internal reinforcement if required.

We claim:

1. A drawer construction having front and side walls formed from hollow extruded panels, each panel having at least one box-like section with open ends, the panels being interconnected by corner components each of which comprises a cornerpost having locating members projecting therefrom at right angles to one another and engaged in the open ends of the respective box-like sections, and projecting detents carried on the locating members so as to be depressed when the locating members are inserted to spring out into engagement with apertures in the panels when the locating members are pushed home, the detents on each locating member which engages the front panel being located on the side toward the inside of the drawer so that such detents are not visible when the drawer is viewed from the front.

2. A drawer construction according to claim 1 in which the back and side panels of the drawer are formed from identical hollow extruded plastic panels each provided with a longitudinal recess in the face thereof which will be innermost in use in order to accommodate a drawer bottom, each panel consisting of upper and lower hollow portions interconnected by a single longitudinal web which defines a longitudinal groove or channel in the face of the panel opposite to that in which said longitudinal recess is formed, the channels so formed in the panels forming the sides of the drawer being adapted to locate on runners forming part of a cabinet or the like in which the drawer is supported in use, and the front of the drawer having a longitudinal recess in the face thereof which will be innermost in use for co-operation with said recesses in the other wall panels.

3. A drawer construction according to claim 2 in which the side wall panels are connected to the rear wall panel at right angles by upper and lower corner pieces comprising posts having projecting locating members engaging in the open ends of the respective upper and lower hollow portions of the panels and retained by means of detents engaging apertures formed in the wall panels.

4. A drawer construction according to claim 2 in which the upper and lower hollow portions of the side and back panels are of identical construction save for the provision of said longitudinal recess in the innermost face of the lower portion.

5. A drawer construction according to claim 3 in which the corner posts are arranged such that the portions thereof which remain exposed following connection of the panels are of slightly different lengths when viewed in plan such that the panels overlap one another at the inside of the corners.

* * * * *